US005343949A

United States Patent [19]

Ross et al.

[11] Patent Number: 5,343,949

[45] Date of Patent: Sep. 6, 1994

[54] ISOLATION WASHPIPE FOR EARTH WELL COMPLETIONS AND METHOD FOR USE IN GRAVEL PACKING A WELL

[75] Inventors: Colby M. Ross; Dhirajlal C. Patel, both of Carrollton, Tex.; Timothy F. LaBruyere, Houma, La.

[73] Assignee: Halliburton Company, Houston, Tex.

[21] Appl. No.: 943,100

[22] Filed: Sep. 10, 1992

[51] Int. Cl.[5] ..... E21B 43/00

[52] U.S. Cl. ..... 166/278; 166/51

[58] Field of Search ..... 166/278, 51, 385, 387

[56] References Cited

U.S. PATENT DOCUMENTS

| | | | |
|---|---|---|---|
| 4,253,522 | 3/1981 | Setterberg, Jr. | 166/278 |
| 4,726,419 | 2/1988 | Zunkel | 166/278 X |
| 4,832,129 | 5/1989 | Sproul et al. | 166/387 |
| 4,842,057 | 6/1989 | Lubitz | 166/278 X |
| 5,103,902 | 4/1992 | Ross et al. | 166/120 |

*Primary Examiner*—Thuy M. Bui

*Attorney, Agent, or Firm*—Tracy W. Druce; Dennis T. Griggs

[57] ABSTRACT

A zonal isolation washpipe system for isolating a production zone which intersects a wellbore from communication with the surface comprises a seal assembly adapted for sealing engagement within the bore of a well packer disposed about the external circumference of one end of a tubular washpipe, a releasable connector system on the other end of the washpipe which provides means for retrieval of the washpipe from the well bore is placed in sealing engagement by a releasable telescoping expansion joint which is resistant to undesired or premature extension.

When it is desired to place the isolated zone on production, a tubing perforator, such as a jet perforator which is commonly known in the art is lowered into the bore of the wash pipe to a location adjacent previously formed perforations in the casing and the wash pipe is perforated.

A method for gravel packing a well using the described tools is also presented.

23 Claims, 13 Drawing Sheets

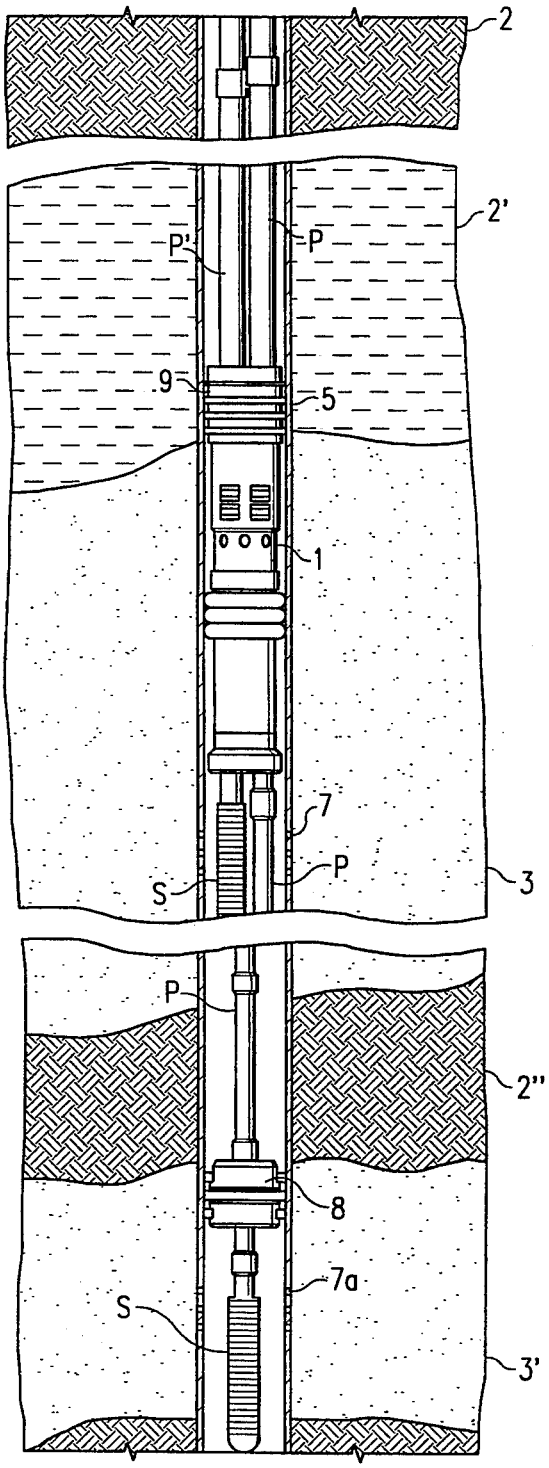
FIG. 1
(PRIOR ART)
FIG. 5
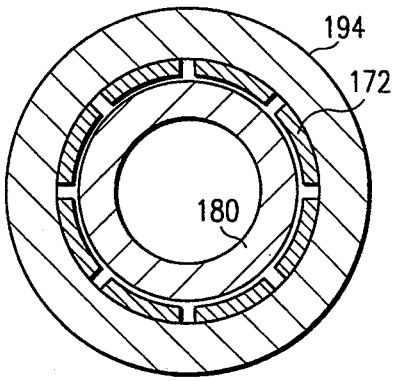

FIG. 3A
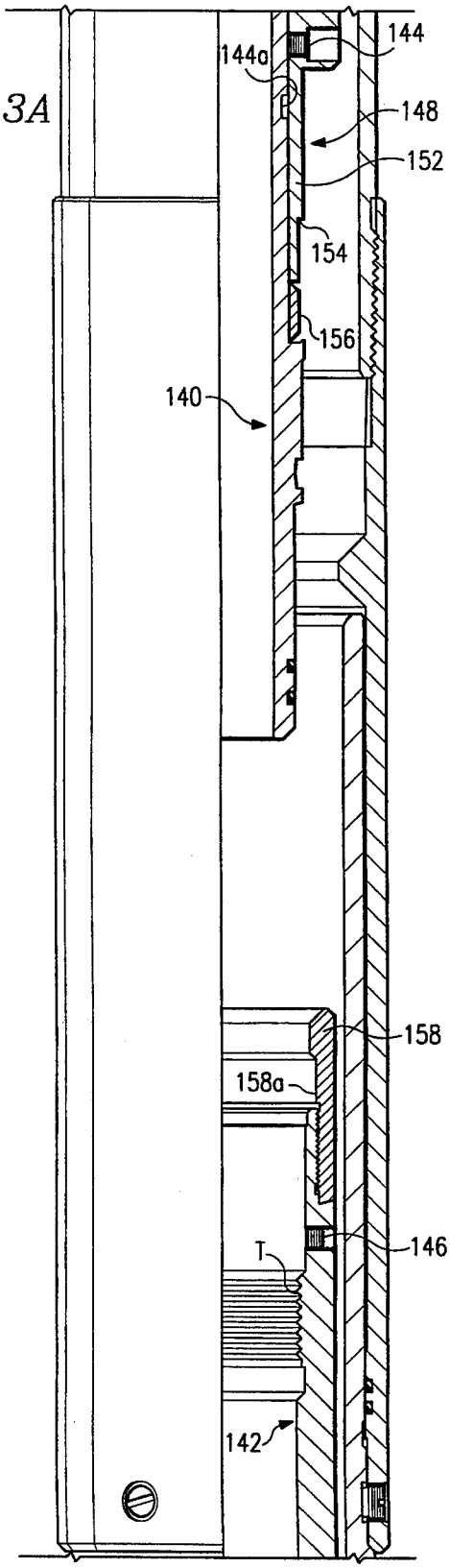
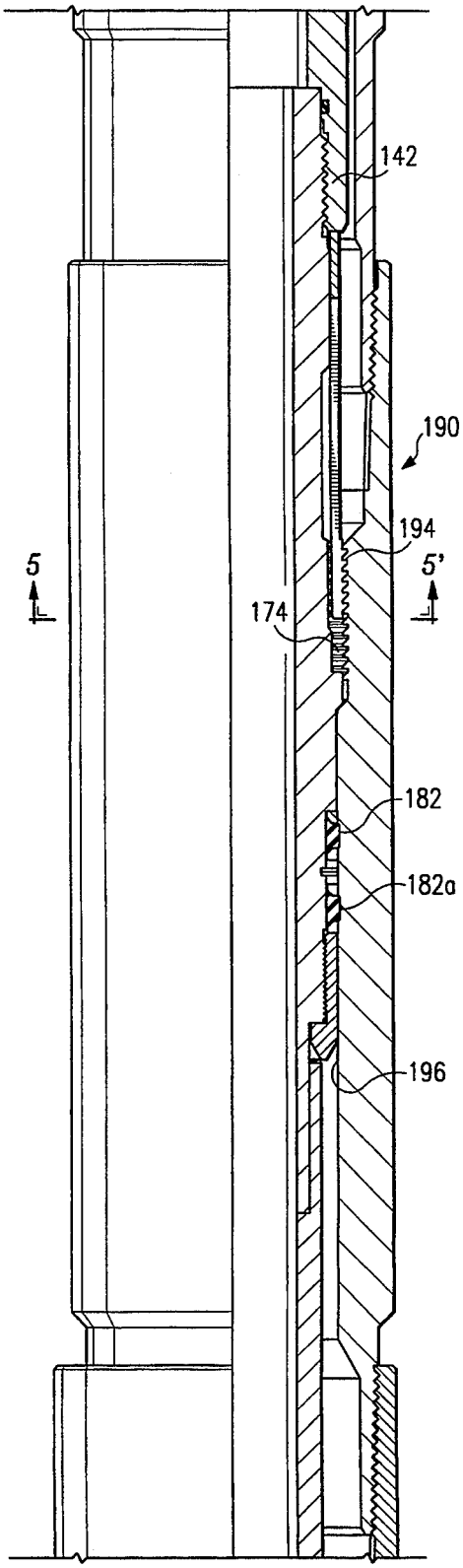
FIG. 3B

ISOLATION WASHPIPE FOR EARTH WELL COMPLETIONS AND METHOD FOR USE IN GRAVEL PACKING A WELL

FIELD OF THE INVENTION

This invention relates generally to methods and apparatus for oil and gas well completions, and in particular to methods for isolating distinct production zones which intersect a single well bore from each other.

BACKGROUND OF THE INVENTION

In a typical well completion it may be desirable to isolate one pay zone from another so that only one zone is produced at a time. Such isolation is typically accomplished by the placement of well packers in the well bore on either side of each pay zone. The sequence of production of multiple pay zones which are tapped individually is typically dictated by well and reservoir conditions. Such conditions may include different fluid loss characteristics from zone to zone, downhole well pressures which differ from zone to zone, and differing mineralogic conditions from zone to zone.

In addition to reservoir and well conditions, the cost of completion is typically an overriding factor because each packer which is used to isolate the pay zones from each other is usually relatively expensive. Also, the time it takes to complete a well is partially determined by the expense associated with renting drilling rigs, which is costly. Therefore any completion method which can reduce the time required to complete a well provides a net savings to the producer.

DESCRIPTION OF THE PRIOR ART

Typically, wells in which multiple production zones intersect the well bore are completed from the bottom up. In a typical completion where isolation of pay zones is desired so that only one zone is produced at a time, such pay zones are typically isolated from one another by the placement of well packers within the well bore on either side of each pay zone.

In order to sequentially produce from discrete zones in such wells, a sump packer is placed in the well bore below the deepest pay zone. Another packer, which may be either a permanent or a retrievable packer, is placed above the deepest pay zone. Between the two packers is placed a well filtration device, such as a screen, slotted liner, perforated pipe or sintered metal tube as is well known in the art to reduce sand production and such other completion equipment as may be desirable. Hereinafter, "well screen" means any well filtration device intended to inhibit the flow of fines into the production tubing. Production tubing is stung into the upper packer to convey produced fluids to the surface, and the well is produced. When the deepest pay zone is depleted or otherwise becomes unproductive, the production tubing is removed from the upper packer and replaced with a plug. Another packer is run into the well above the next shallower pay zone, a well screen is hung off from the packer and the production tubing is stung into that packer. The next shallower zone is then produced. The process is continued up the well bore from pay zone to pay zone until all zones have been depleted.

The major drawback to this method of production is that it is very costly. The packers employed in the process are expensive. In addition, a workover rig must be moved on site to remove and replace the production tubing and set new packers each time a production zone is depleted, also at great cost.

An alternative prior art method of sequential zone production is depicted in FIG. 1. This figure depicts a type of well completion well known in the art commonly called a dual string completion. A dual string completion allows two discrete producing zones to be produced before the well must be reworked. In a dual string completion, well bore 1, which may be essentially vertical or deviated from the vertical and having a deviation ranging from only a few degrees from vertical to more than 90°, will normally pass through several layers of overburden, 2 and 2' which lie above the shallowest production zone. The well bore may also pass through one or more layers of nonproducing material, 2'' located between producing zones. Below the layers of overburden 2, 2' and between layers of nonproducing material 2'' will be found producing zones 3, 3' which contain well fluids of interest.

Frequently the well bore 1 will be lined with a tubular casing 5 which is cemented in place and subsequently punctured with a plurality of perforations 7, *7a*. The perforations 7, *7a* are localized within the producing zones 3, 3'.

Adjacent producing zones 3, 3' are mechanically separated within the casing string 5 by combinations of single string well packers 8 and dual string well packers 9. A single string well packer has provision for one flow conduit to pass therethrough, and a dual string packer has provision for two flow conduits to pass therethrough.

The dual string well packer 9 will have a well screen S hung off from one of its flow bores and a production string P connecting the other bore of the dual string packer 9 to the single string packer 8. As with dual string packer 9, single string packer 8 also has a well screen S hung off from it.

The well screens S are positioned in well bore 1 so that they are adjacent perforations 7 and *7a*, respectively.

In this type of completion, well fluids from upper producing zone 3 are not commingled with fluids from lower producing zone 3' because separate production strings P, P' extend from dual string packer 9 to the earth's surface. As shown in FIG. 1, the production string P is connected to well screen S, which is hung off from single string packer 8, and production string P' is connected to well screen S, which is hung off from dual string packer 9.

However, dual string packers, such as that shown in FIG. 1 are very expensive when compared to the cost of a single string packer, so that this type of completion is not very desirable from the economic point of view. In addition, in a dual string completion such as that described herein, the lower zone is frequently exposed to completion fluids for an extended period of time while the upper zone is completed and the dual packer is run in place. This extended exposure to completion fluids is frequently detrimental to the production capabilities of the lower zone.

As an alternative to the zonal production methods described above, an entire well might be placed on production utilizing a sump packer below the deepest pay zone and a second packer above the shallowest pay zone. However, this non-zonal method of production is frequently not desirable because pressure and temperature characteristics, as well as other mineralogical factors which may be different from zone to zone, may cause reservoir damage. When such reservoir damage occurs, the overall producing life of wells in the reservoir can be seriously diminished and oil which might have been normally produced if such reservoir damage did not exist will be lost.

An additional alternative to zonal production in which well workovers are required to bring each zone on production is the utilization of wash pipes which depend from each packer and extend into sealing engagement with the next lower packer. In this embodiment, each successive zone is brought on production by running a jet perforator into the wash pipe to the zone of interest and punching holes through the wash pipe at that location.

The shortcoming of this prior art method of washpipe isolation is that such systems require several trips into the hole with wash pipes which are stacked upon the next lower packer to effect a seal between the packer and the washpipe to isolate one pay zone from another. The use of several units to complete the well in this manner also exposes the formation to well completion fluids for a long period of time which may cause damage to the producing formation. Should such formation damage occur, it will be difficult to achieve a uniform and therefore effective gravel pack, should one be required and could result in reduced production from the well.

Also, in prior art one trip washpipe assemblies, such wash pipes are prone to premature release from the running tool, thereby necessitating a costly fishing job to recover the dropped or lost wash pipe.

OBJECTS OF THE INVENTION

It is therefore a primary object of the invention to provide a zonal isolation washpipe which reliably and predictably releases from the run in string.

It is a further object of the invention to provide a zonal isolation washpipe which utilizes a simple and reliable seal system to seal the washpipe within a production string.

It is a still further object of the invention to provide a washpipe isolation system which does not inhibit the ability to gravel pack or chemically treat a well production zone.

Another object of the invention is to provide a wellbore zonal isolation system which allows the application of fluid treatments to a wellbore in a single tubing run.

Another and further related object of the invention is to provide an isolation system which can be run in the initial completion pipe trip.

A still further and related object of the invention is to provide a zonal isolation system which is utilizable in both vertical as well as deviated and horizontal well bores.

SUMMARY OF THE INVENTION

The foregoing objects are provided according to a preferred embodiment of the present invention by a zonal isolation washpipe system comprising a seal assembly adapted for sealing engagement with the bore of a well packer disposed about the external circumference of one end of a tubular washpipe and a releasable connector system on the other end of the washpipe which also provides means for retrieval of the washpipe from the well bore together with a releasable telescoping expansion joint which is resistant to undesired or premature extension.

On run in, the isolation washpipe system is run into the well bore simultaneously with production tubing, which may include a sand screen, together with an upper packer. The production tubing is landed in a previously set sump packer. After the upper packer has been set in the well casing, the inner string, which includes the isolation wash pipe and its running tool is picked up until opposing shoulders on the production tubing support ring and on the running tool no-go against each other. This contacting engagement of the no-go shoulders allow a telescoping expansion joint to be extended and a wash pipe release mechanism to be activated. The wash pipe is then set down until the seal system disposed about the lower end thereof engages a polished seal bore in the sump packer. A ratchet profile at the upper end of the wash pipe engages a corresponding profile on the internal circumference of the production string.

Once the wash pipe is latched into the ratchet profile, an annular space is formed in the production tubing between the preperforated screen base pipe and the exterior of the wash pipe. This annular space is sealingly isolated from the production tubing by the seal assemblies disposed about the wash pipe so that fluids which might be produced from the pay zone adjacent the wash pipe are prevented from entering the production string at that point.

When it is desired to place the isolated zone on production, a tubing perforator, such as a jet perforator which is commonly known in the art is lowered into the bore of the wash pipe to a location adjacent previously formed perforations in the casing and the wash pipe is perforated. In an alternative method, one or more sleeve valves, not shown, can be threadedly inserted into the wash pipe. The sleeve valves can be opened or closed using wire line methods well known in the art as an alternative to perforating the washpipe as aforesaid. This perforation of the wash pipe or opening of the sleeve valves places the previously isolated zone on production.

In an alternative embodiment of the invention, additional pay zones within the same wellbore may be similarly isolated at the time the well is initially completed by stacking one isolation wash pipe assembly on top of another with an intervening well packer having a polished seal bore extension in its throat between each washpipe. Once the stacked washpipe assemblies are in place, the washpipe can be perforated as aforesaid, and, once a zone has been depleted, the sleeve valve in the washpipe or the wash pipe itself can be plugged at the next shallower packer. The pipe can then be perforated adjacent the next shallower zone or a sleeve valve opened to bring that zone on production.

The novel features of the invention are set forth with particularity in the claims. The invention will best be understood from the following description when read in conjunction with the accompanying diagrams.

BRIEF DESCRIPTION OF THE DRAWINGS

FIG. 1 is a view, partially in section and partially in elevation of a PRIOR ART zonal isolation completion.

FIGS. 3A and 3B are views, partially in section and partially in elevation of the latch assembly of the instant invention in the unlatched position.

FIG. 5 is a cross section of the device taken along line 5—5' in FIG. 3B.

DETAILED DESCRIPTION OF THE PREFERRED EMBODIMENTS

Figure 2A:
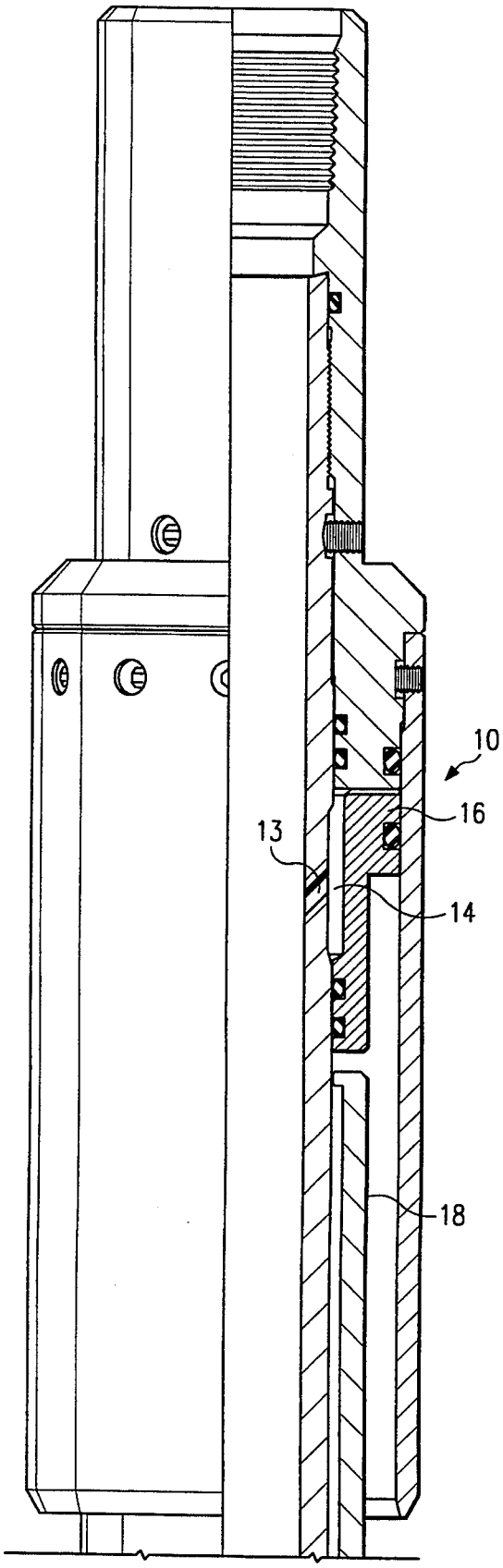
FIGS. 2A through 2S are views, partially in section and partially in elevation of a well completion which employs the invention.

In the description which follows, like parts are marked throughout the specification and drawings with the same reference numerals, respectively. The drawings are not necessarily to scale and the proportions of certain parts may have been exaggerated to better illustrate the details and features of the invention. As used herein, "S" refers to a well filtration device, such as a well screen as is commonly known in the art, and "T" refers to a threaded union.

It is to be understood that although the invention is presented in the context of a gravel pack system and gravel packing a well, it is not necessary that a gravel pack job be performed. Likewise, it is also intended that other well stimulation tools could be substituted for the gravel pack tools shown, and, again it is not necessary that any such stimulation job be performed.

Figure 2B:
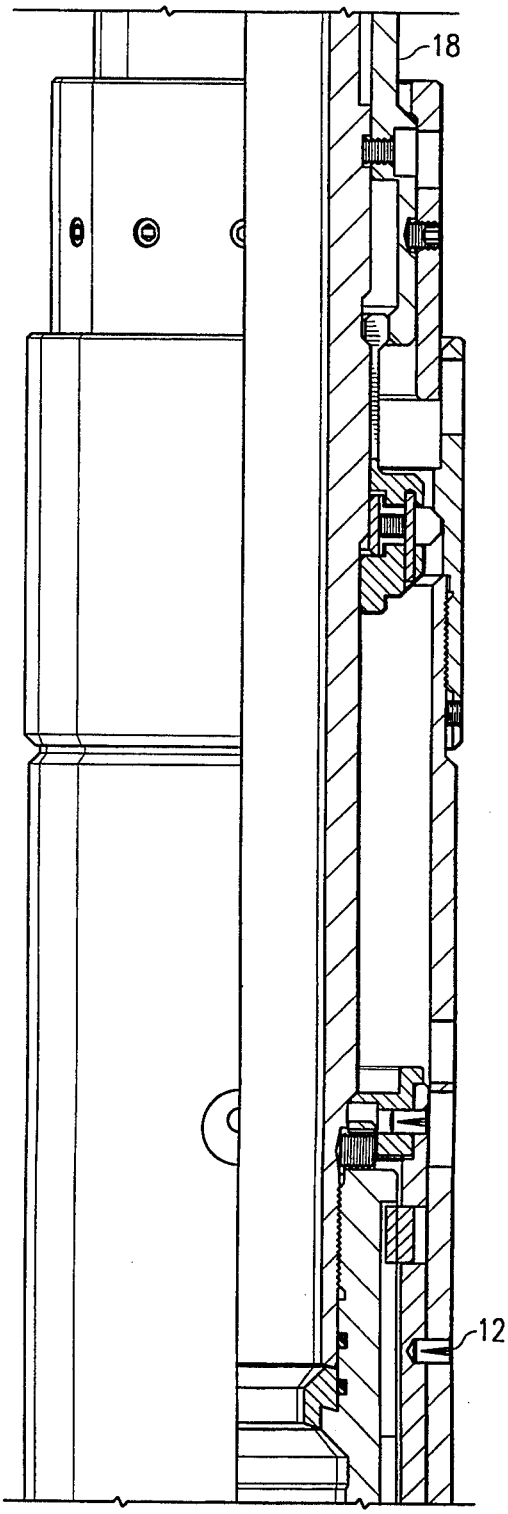
Figure 2C:
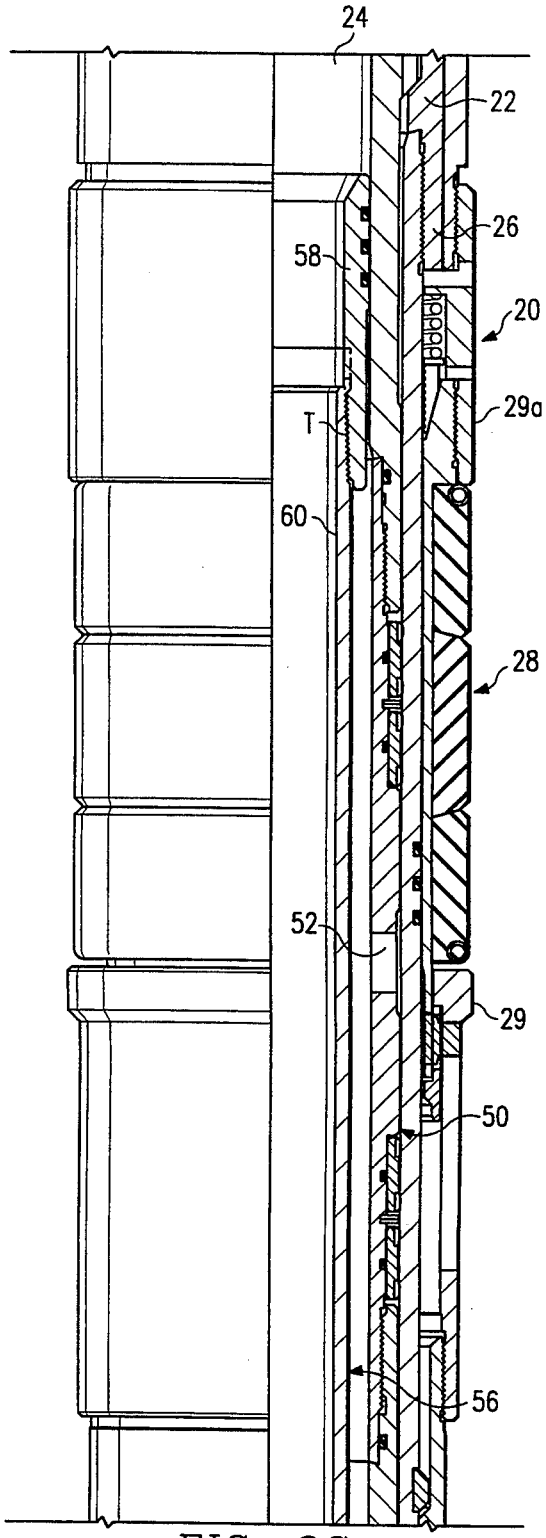
Figure 2D:
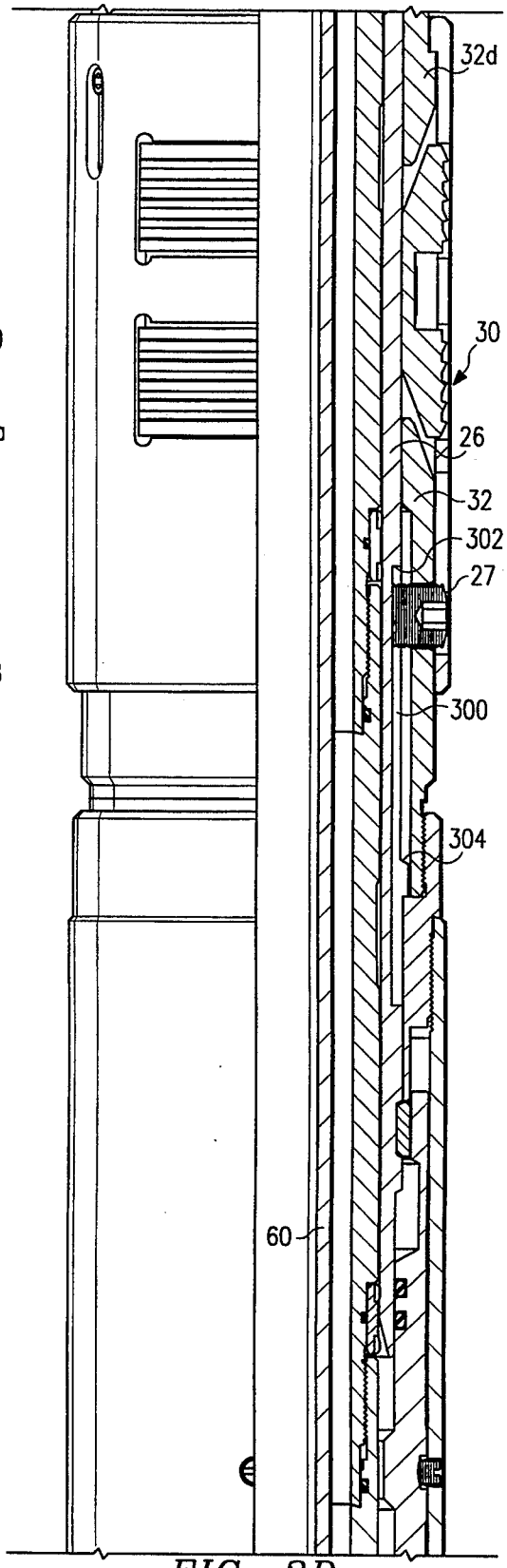
Figure 2E:
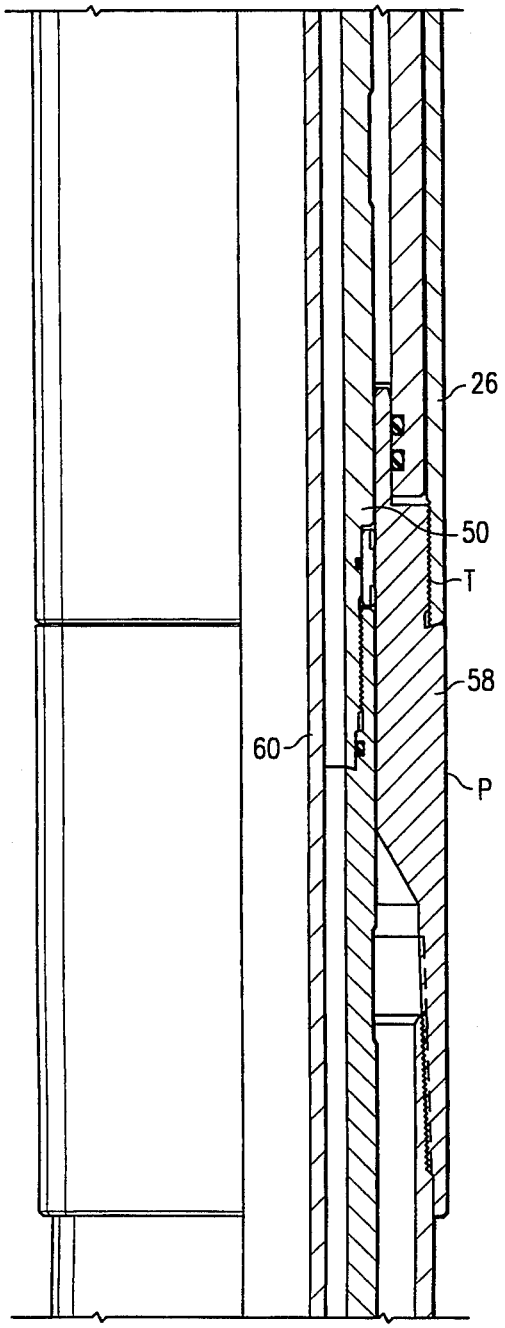
Figure 2F:
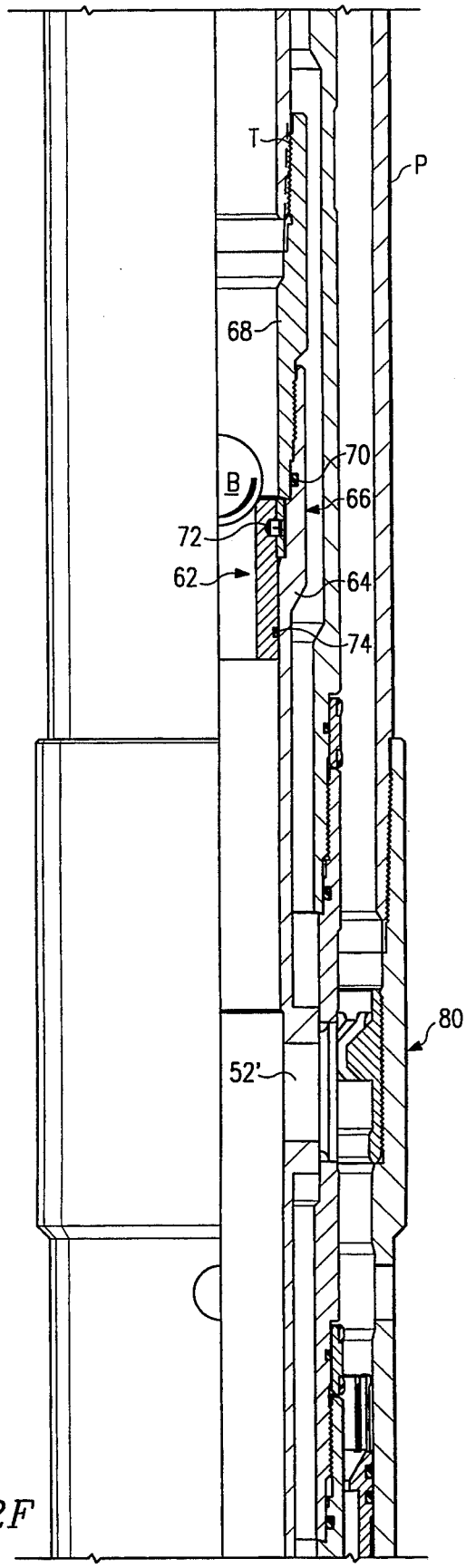
Figure 2G:
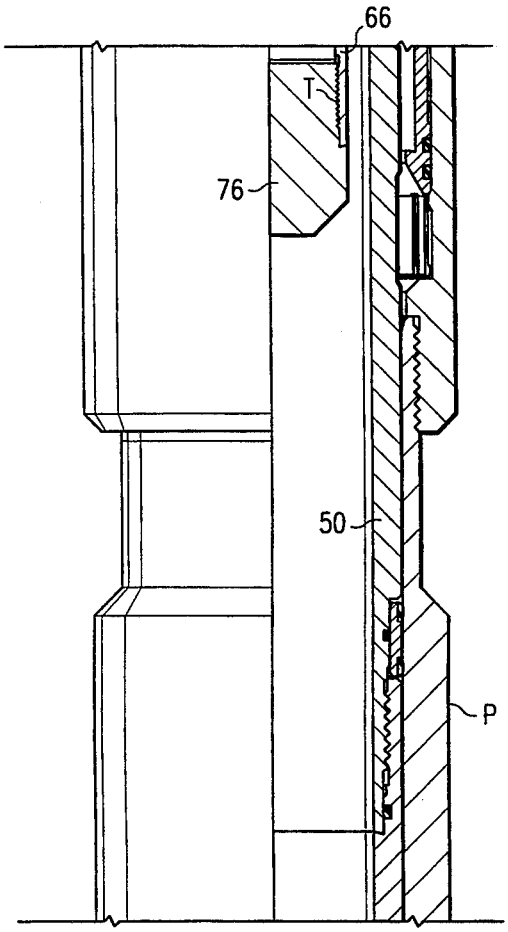
Figure 2H:
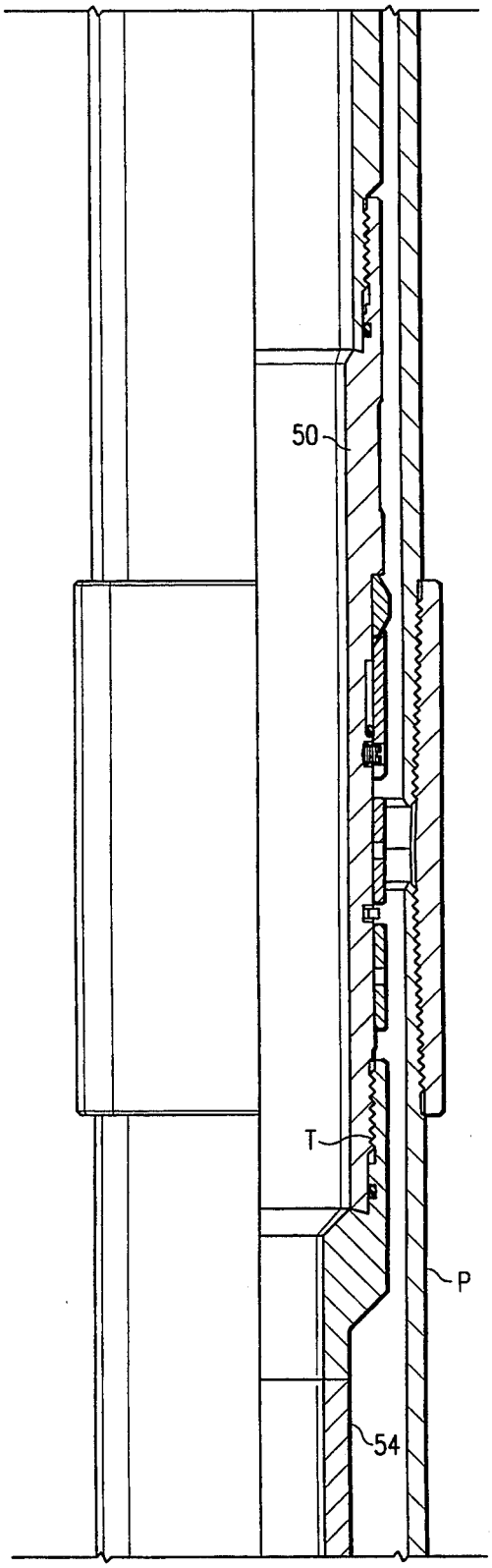
Figure 2I:
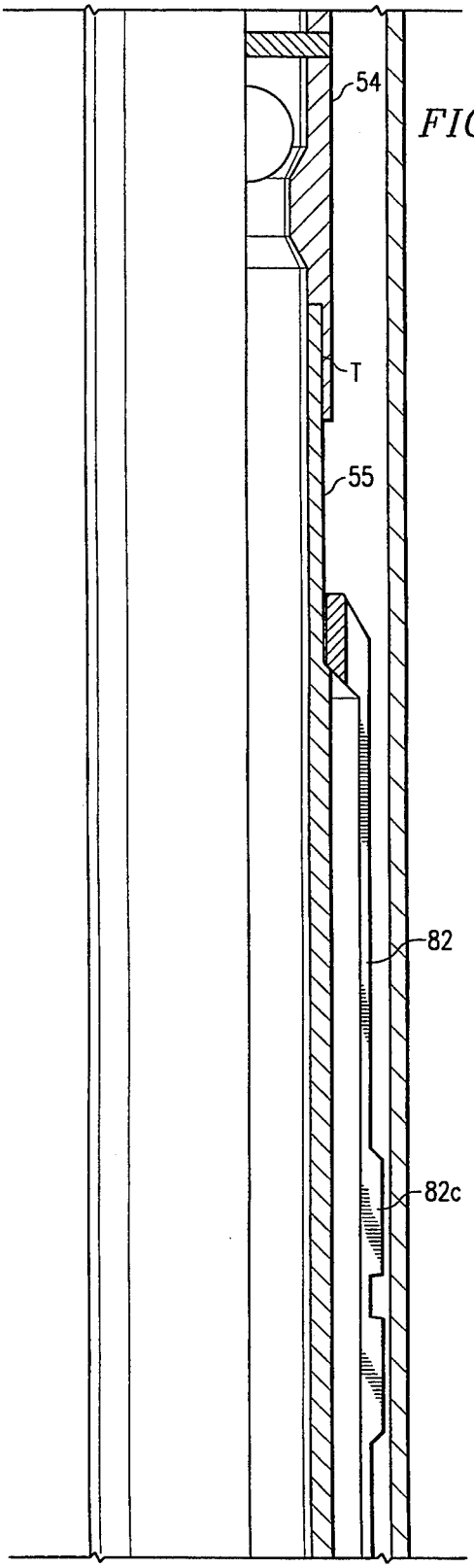
Figure 2J:
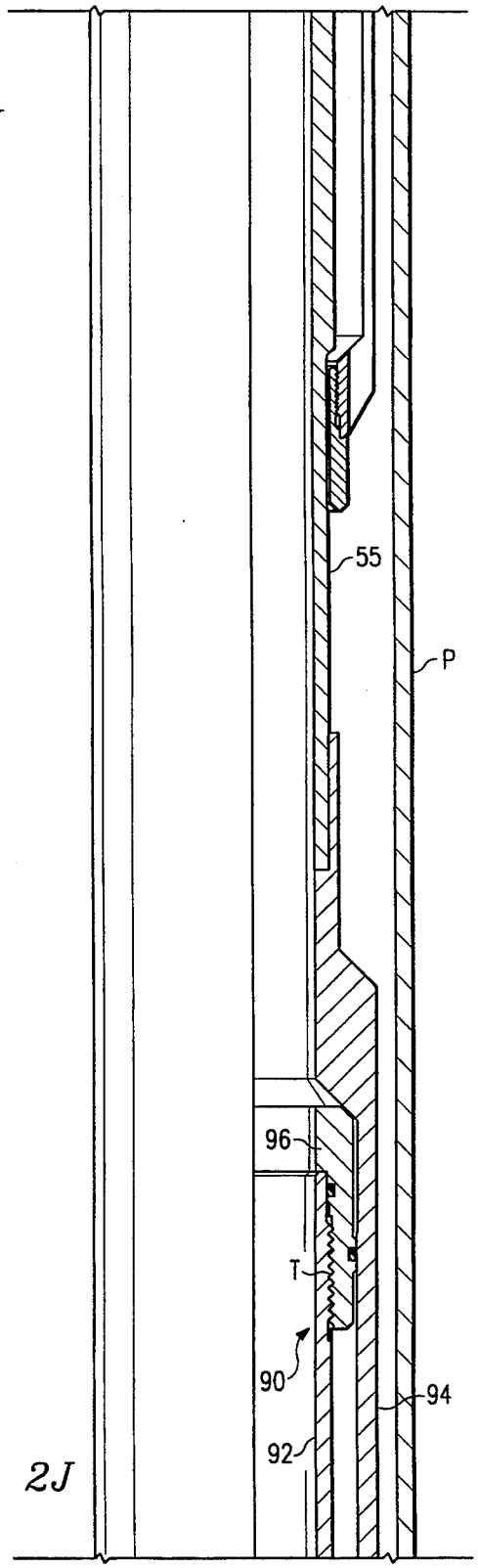
Figure 2K:
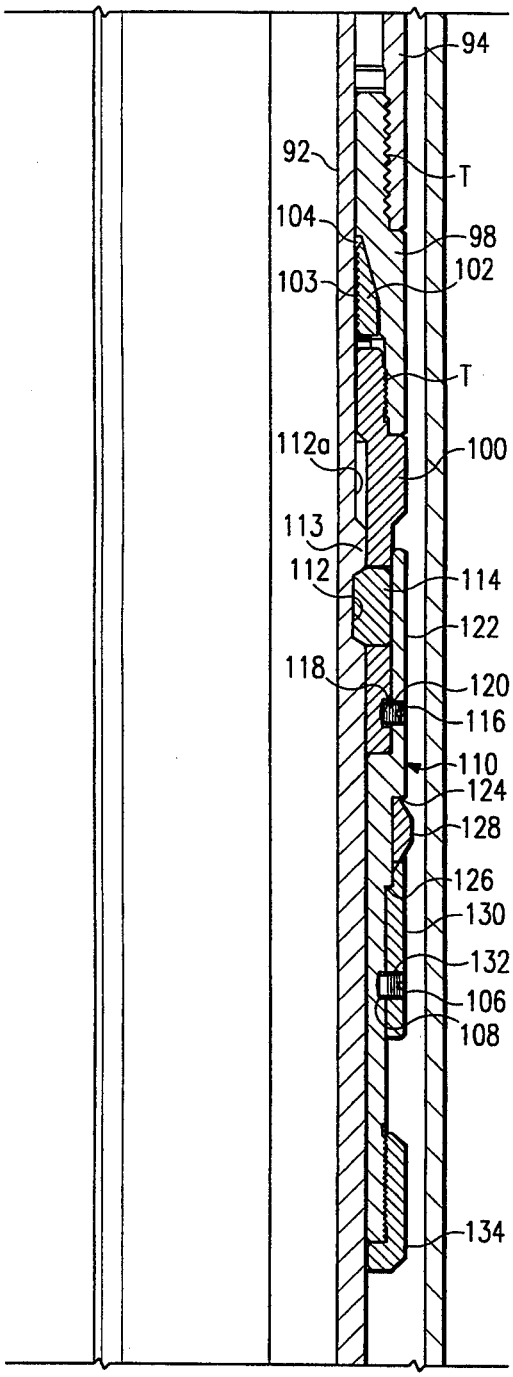
Figure 2L:
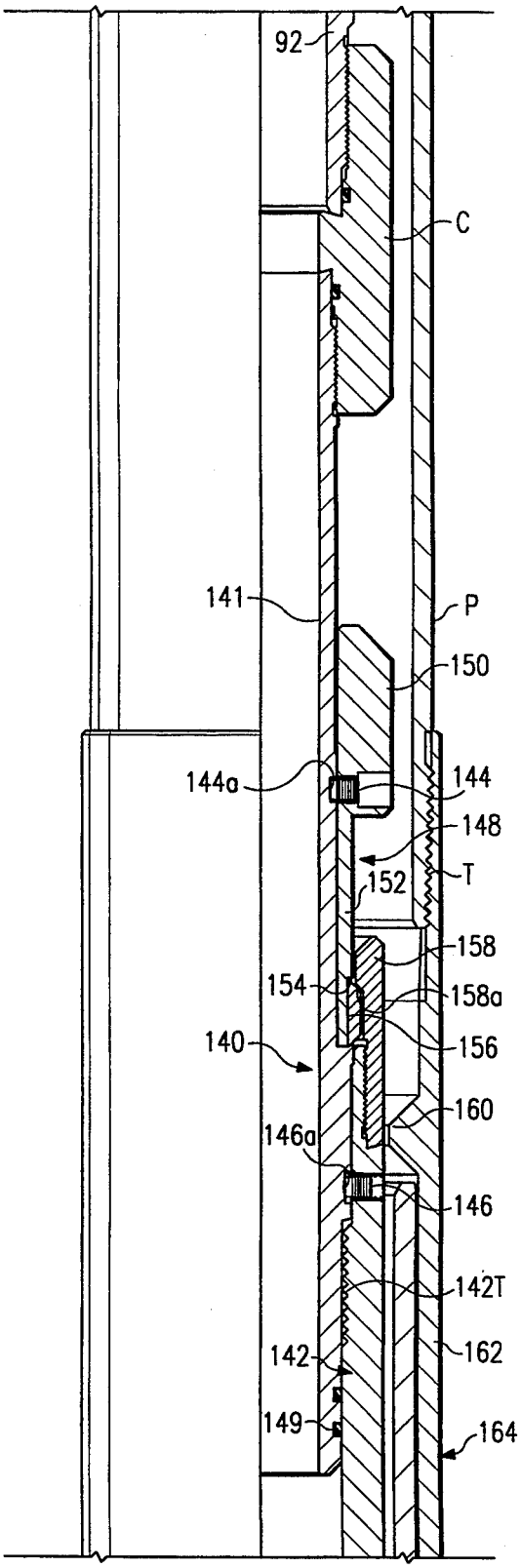
Figure 2M:
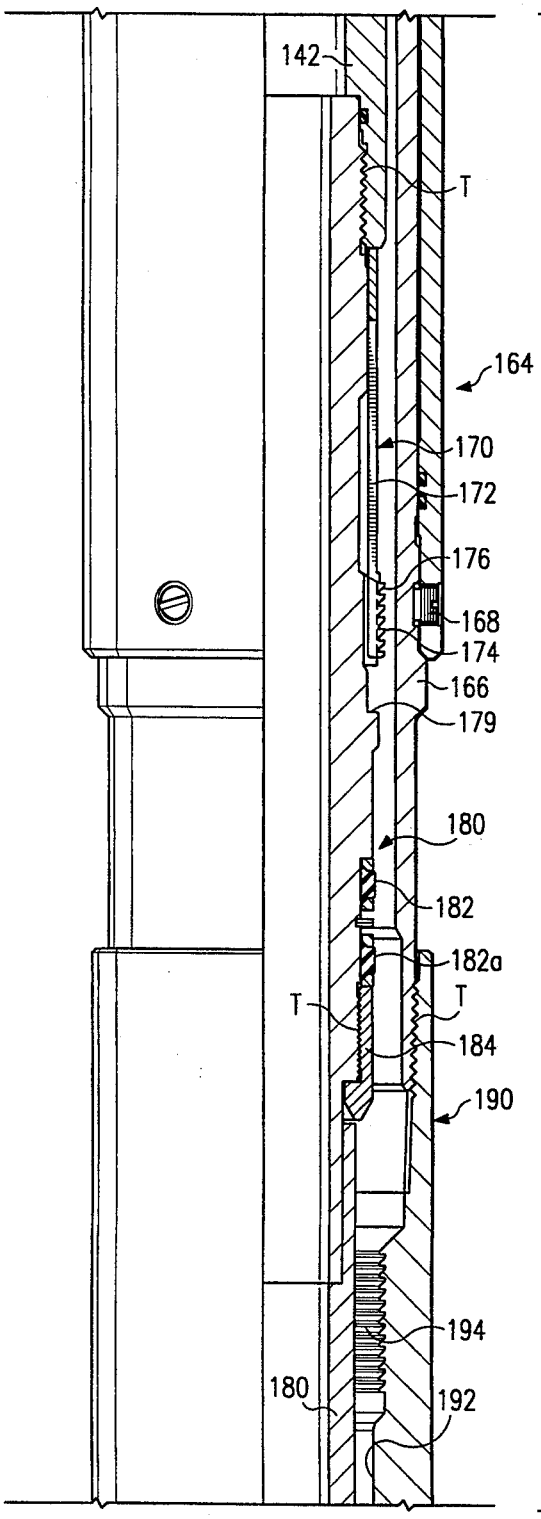
Figure 2N:
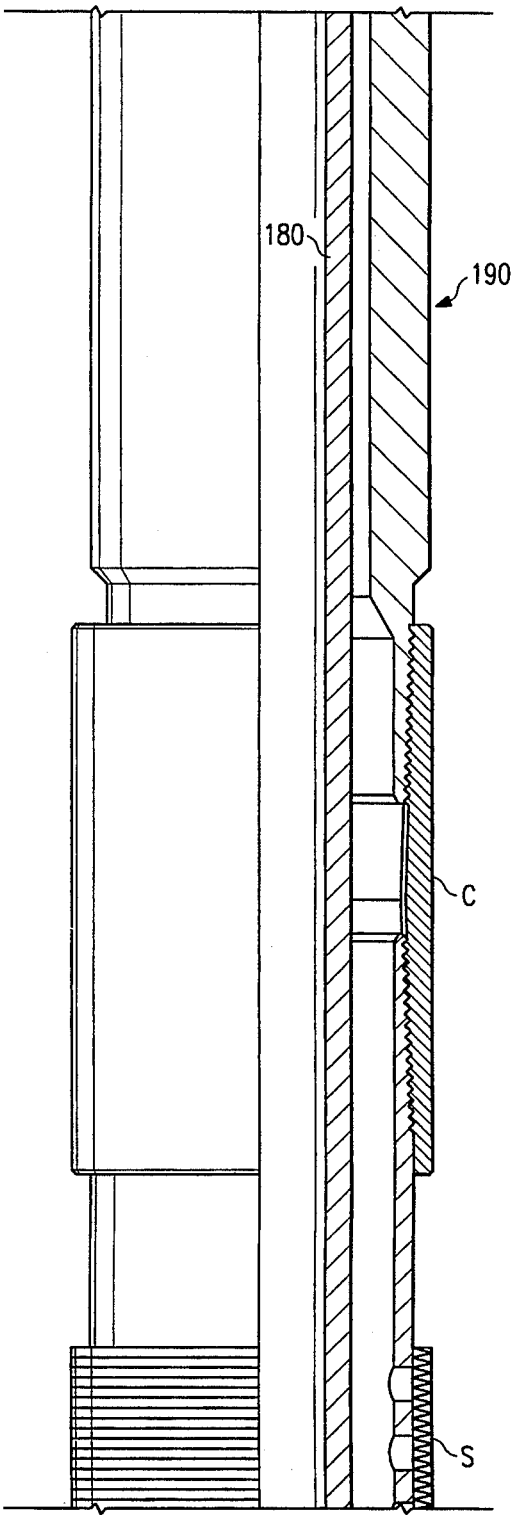
Figure 2P:
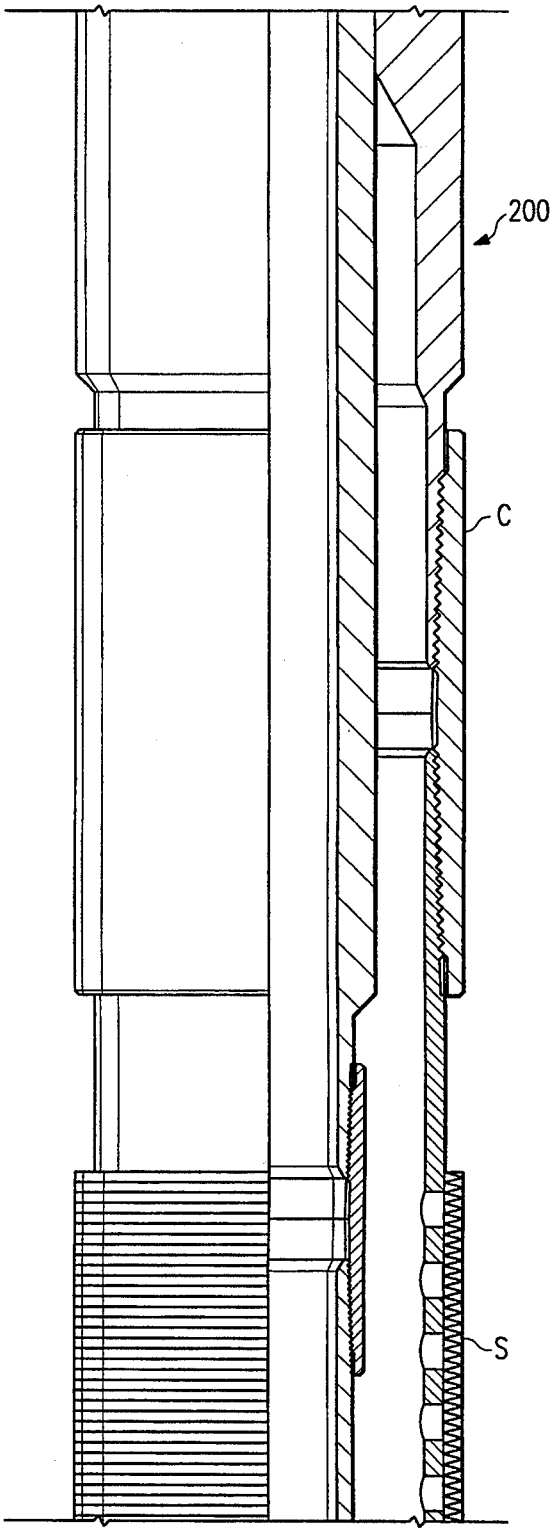
Figure 2Q:
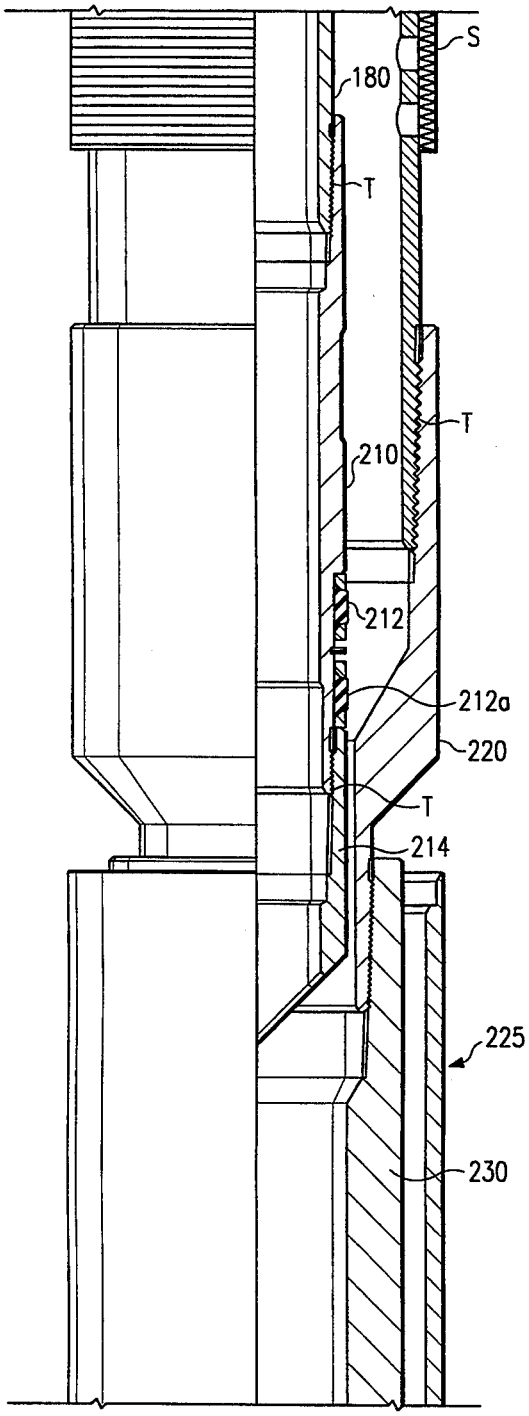
Figure 2R:
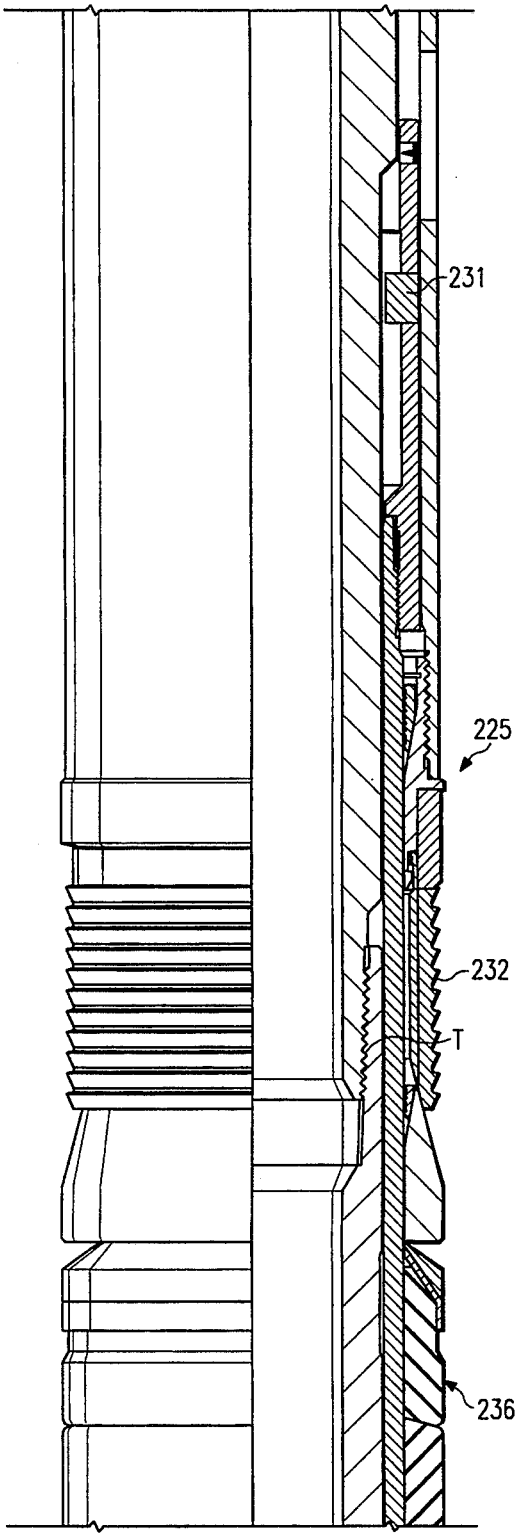
Figure 2S:
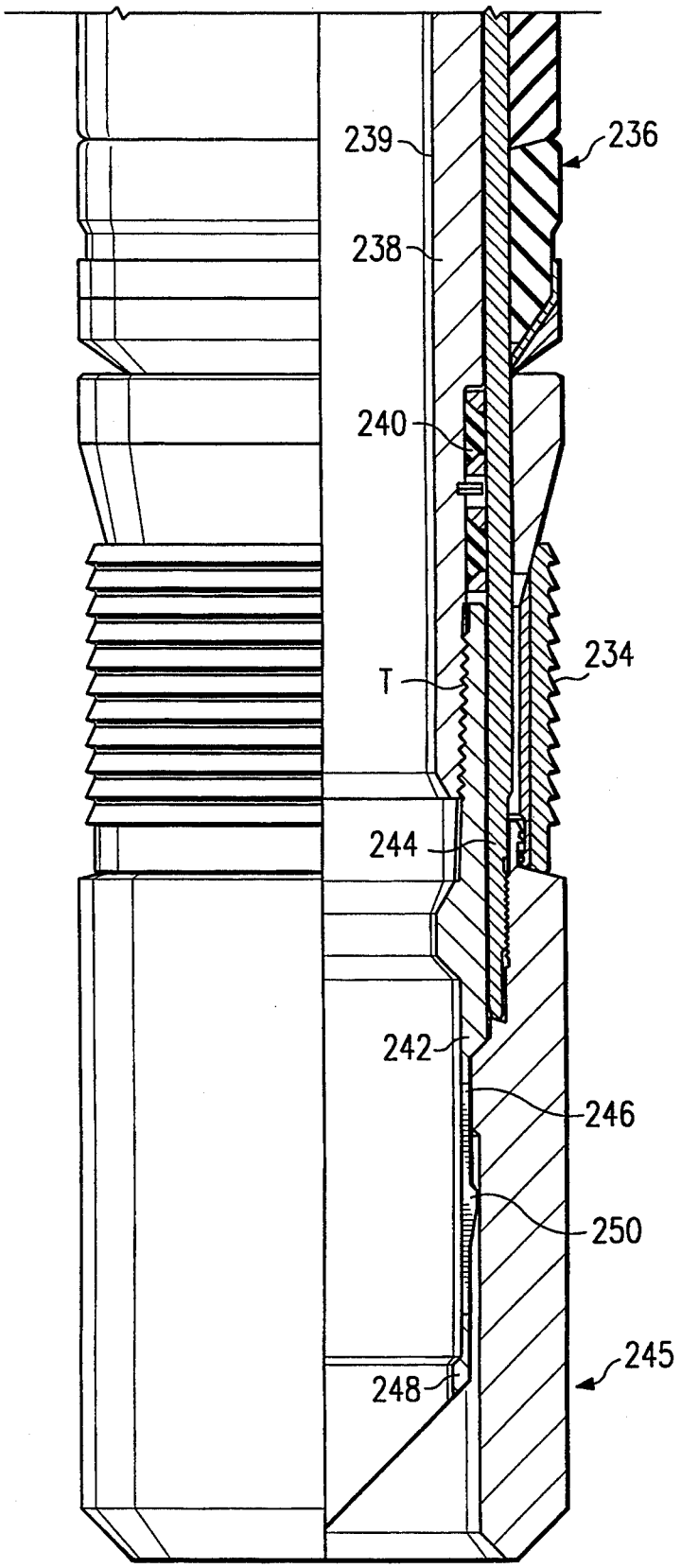

Referring now to FIGS. 2A through 2S, a gravel pack system is shown from the top down in the run - in position. It is to be understood that, although the invention is shown vertically in the drawings, it may also be run in deviated or horizontal wells.

In FIGS. 2A and 2B, a hydraulic packer setting tool 10, described below, is shown shearably attached to a hydraulically set packer 20, such as the Versa - Trieve ® packer sold by Otis Engineering Corporation, Dallas, Texas and shown in U.S. Pat. No. 5103,902 by shear screws 12. Of course, one skilled in the art will recognize that any suitable well packer may be employed in this application without regard to the means or method employed to set the packer, which, by way of example and not by means of limitation, may include mechanical, hydraulic or electric line actuated setting devices.

The hydraulically set packer 20 is comprised of a strengthened tubular inner mandrel 22 which defines the outer boundary of longitudinal packer bore 24. The longitudinal packer bore 24 is in flow registration with the production string above and below the packer cooperating therewith to establish a flow passage for produced fluids from the producing formation to the surface.

Concentrically disposed about the exterior of the inner mandrel 22 is an outer packer mandrel 26 which is adapted to carry a sealing element package 28, which is comprised of one or more elastomeric sealing elements, and a slip carrier assembly 30.

The outer packer mandrel 26 is threadedly attached at threaded union T to the production string which consists of several lengths of blank pipe which comprise production string P. The blank pipe is of sufficient length to position the well screens S adjacent the producing zone 3, 3'.

Concentrically disposed within the longitudinal packer bore 24 is a gravel pack service tool 50, such as that disclosed in U.S. Pat. No. 4,832,129, and concentrically disposed within the service tool 30 is a ball catcher sub 66, which is commonly known in the art.

Referring now to FIGS. 2C through 2F, the ball catcher sub 66 is comprised of a seal collar 64 which is threadedly attached at union T to a connecting collar 68. Releasably attached to the seal collar 64 is an expendable ball seat assembly 62.

An o-ring seal 70 is interposed between the upper sub 68 and the lower sub 64 to prevent fluid leakage therebetween. The resilient ball seat 62 is slidably mounted and retained in position within the lower sub 64 by shear pin 72. The resilient ball seat 62 is sealed against fluid leakage therearound by o-ring seal 74.

Threadedly attached to the lower sub 64 at threaded union T is blind catcher 76 (FIG. 2G) which holds the drop ball B after the ball seat has been expended from the catcher sub as described below.

The gravel pack service tool 50 is an elongate tubular structure which is in flow communication with a tubular work 6 string, not shown, which carries various completion and gravel pack fluids to the well bore from the surface. The tubular structure has several ports 52, 52' which can be aligned with a sleeve valve 80 as it is reciprocated within the longitudinal bore 24 during the gravel pack process. Threadedly attached at union T in flow registration with the bore of the gravel pack service tool 50 is a check valve sub 54 (FIG. 2H) of the conventional ball - check variety which is positioned to prevent the flow of fluids down the service tool during the gravel packing operation and to allow excess fluids to return to the surface therethrough.

Attached to the check valve sub 54 is a tail pipe (FIG. 2I) and mounted on the tail pipe is a collet type shifter 82 which is adapted to move the sleeve valve 80 between its open and its closed positions. The resiliency of the collet portion 82C of the shifter 82 allows it to move into and out of engagement with a shifting profile located on the interior of the sleeve valve 80.

As shown in FIGS. 2 J and 2K, a telescoping expansion joint 90 is attached to the tail pipe 55 below the collet shifter. The telescoping expansion joint 90 comprises an inner tube 92 concentrically disposed and slidably mounted within an outer tube 94. An upper slide stop 96 is threadedly attached to said outer tube at union T and a lower slide stop 98, which is in slidable and sealing engagement with the outer tube 94 is threadedly attached at union T to the opposing end of the inner tube 92.

An internal slip retainer 100 is threadedly engaged with the lower slide stop 98 at threaded union T and cooperates therewith to retain a triangularly shaped internal slip 102 within an internal slip chamber 104. The base of the internal slip 102 has a serrated finish 165 which enters into biting engagement with a corresponding roughened, or phonograph, finish on the exterior wall of the inner tube 92 when the inner tube 92 and the outer tube 94 are moved into extended relationship with respect to each other. The serrations are pitched with reference to the corresponding serrations on the internal slip 102 to allow extension of the tubes relative to each other and to prevent their retraction. On run in, the inner tube 92 is restrained in a fully enclosed and retracted relationship with respect to the outer tube 94 by a secondary shear screw 106 which is threadedly inserted into a bore 108 in secondary shear screw carrier 110, described below.

The inner tube 92 has an outer detent 112 and inner slideway, **112*a* honed into its outer surface with a raised intermediate ring 113 therebetween. A set of lugs 114 are retained in the outer detent 112 by a primary shear screw carrier 110. A primary shear screw 116 protrudes into a screw depression 118 in the internal slip retainer 100**.

The primary shear screw carrier 110 has a threaded shear screw bore 120 located intermediate a flexible and resilient snap ring retainer 122 which extends over the lugs 114 and the first of two radially inwardly stepped shoulders 124 into which is threadedly inserted the primary shear screw 116.

External to the first radially inwardly stepped shoulder 124 and remotely placed from it is a second radially inwardly stepped shoulder 126. The space between the first shoulder 124 and the second shoulder 126 forms a prop which an outer snap ring 128 is located.

The outer snap ring 128 is retained on the prop by a secondary shear screw carrier 130. The secondary shear screw carrier 130 has a threaded bore 132 therethrough into which is a inserted secondary shear screw 106. The secondary shear screw 106 protrudes from the bore in the secondary shear screw carrier into a corresponding shear pin bore 108 in the primary shear screw carrier 110.

The outer tube 94 and the assemblies depending therefrom are retained in proper alignment about the inner tube 92 by a collar 134 threadedly attached thereto.

Referring now to FIG. 2L, the inner tube 92 of the expansion joint 90 is threadedly attached to a Ratch-Latch® running tool 140 by means of threaded collar C. Ratch Latch® assemblies are available from Otis Engineering Corporation, Dallas, Tex.

The running tool 140 is used to locate and lock a Ratch-Latch®locking mechanism, discussed below, in a corresponding profile which is machined into the inner wall of a sub which forms part of the production string P.

The running tool 140 including a tubular mendrel 141 which is shearably attached to the upper end of a latching assembly 142 by shear screws 144, 146 which are threadedly inserted into a running tool latch assembly 148 and into the latching assembly 142, respectively. The shear screws 144, 146 are matched so that the same amount of tension applied to the assembly will cause both screws to shear under approximately the same applied force. The shear screws 144, 146 protrude into detents **144*a*, 146*a*, respectively in the running tool 140**.

The running tool latch assembly 148 has an enlarged nose piece 150 into which a shear screw 144 is threaded and an elongated thin tail piece 152. At the end of the tail piece 152 which is remote from the nose piece 150 is a radially inwardly stepped shoulder 154 which forms a prop on which a snap ring 156 is positioned.

Threadedly attached to the top of the latching assembly 142 at union T is a snap ring retainer 158 which is in close proximity to the snap ring 156. The snap ring retainer 158 has a groove **158*a* milled into its inner surface which is sized to mate with the outer surface of the hollow snap ring 156. The running tool mandrel 14 is sealed to the latch mandrel 142 against leakage by O-ring seals 149. Internal threads 142T are formed on the latch mandrel 142** for engaging a retrieving tool (not shown), so that the washpipe may be retrieved.

Referring now to FIGS. 2L and 2M, the safety joint 164 is threadedly attached at its upper end to the production tubing P at threaded joint T and forms a part of the production tubing. The safety joint 164 is threadedly attached at its lower end by threaded union T to a ratch latch profile sub 190, discussed below. The safety joint 164 also has an internal portion 166 which is slidably and sealingly positioned within the bore of the external portion 162 and secured in place by a shear screw 168. The shear screw 168 in the safety joint 164 is rated at a much higher parting strength than any of the other shear screws in the completion. The safety joint 164 functions as an emergency means to remove production equipment from the hole and is not intended to be separated during the life of the well, except under extraordinary circumstances.

Referring now to FIG. 2M, the latching assembly 142 is threadedly connected to a wash pipe 180 at threaded union T and has a plurality of flexible collet latches 170 depending therefrom.

The collet latches 170 comprise a plurality of resilient, flexible collet arms 172 fixedly attached to the latching assembly 142. At the end of each collet arm 172 which is remote from the latching assembly 142 is a plurality of sawteeth 176 formed on an enlarged portion of the collet arm 172. Each sawtooth 176 is angled on the side remote from the latching assembly 142 and radially stepped outwardly on the side nearest the latching assembly 142. The sawteeth are pitched so as to mate with a corresponding profile 174 formed on the inside of the female ratch latch assembly, described below. The angular shape of the sawteeth 176, coupled with the resiliency of the collet arm 172 allows the collet latch 170 to cam over the corresponding profile of the female ratch latch assembly, while the angular shape of the sawteeth 176 prevents the assembly from coming unlatched as a result of a straight pull on the work string.

A resilient seal assembly **182, 182*a* is mounted on the wash pipe 180 and retained in place by a seal retainer 184 which is threadedly attached to the wash pipe 180** at union T.

The Ratch - Latch® profile sub 190, which forms an integral part of the production tubing P has milled within its flow bore 192 a series of helical threads 194 which have the same pitch as the sawteeth 174 of the collet latch 170 which comprises part of the ratch latch latching assembly 140. In addition to the same pitch as the sawteeth 174, the profile also exhibits angled and stepped portions which match the angled and stepped portions, respectively, of the latching profile on the collet latch 170.

With this aggregation of parts, it is therefore possible to push the latching assembly 142 into engagement with the helical threads 194 thereby causing the camming surfaces to slide over one another. However, it is necessary to rotate the latch assembly 140 relative to the profile sub 190 to release one from the other.

Referring now to FIGS. 2N through 2Q, the lower end of the ratch latch profile sub 190 is threadedly connected by threaded collar C to a series of well screens S and at least one seal bore sub 200, described below, which run through the well bore for substantially the entire length of the producing zone(s) 3, 3'.

The seal bore sub 200 is attached to the production string P intermediate sections of well screen S by threaded coupling C and has a radially inwardly sloping shoulder 202 which reduces the diameter of the flow bore 204 which passes therethrough to substantially that of the external diameter of the wash pipe 180. Within the reduced diameter bore portion are located several seals, **206*a*, 206*b* and 206*c* which form a fluid tight bond with the wash pipe 180** as described below.

Referring now to FIG. 2Q, a lower seal sub 210 is threadedly attached at union T to the lower end of the wash pipe 180. At the lower end of the lower seal sub 210 are placed resilient seals 212, 212*a* which are retained in place on the lower seal sub 210 by a muleshoe 214 which is threadedly attached to the seal sub 210 at union T.

Threadedly attached at union T to the bottom end of the lowermost screen is a muleshoe guide 220 which cooperates with the muleshoe 214 to guide the washpipe 180 into the bore of a bottom hole, or sump, packer. The lower end of the muleshoe guide 220 is threadedly attached to a straight slot guide 230 which is positioned by lugs 231 within the bore of the sump packer 225, described below.

The sump packer 225 can be any permanent or retrievable packer which is capable of being set preferably by wire line or by any other means. The particular model of packer shown in FIGS. 2R through 2S is a Model AWD Perma-Series ® packer sold by Otis Engineering Corporation and shown on page 32 of Otis Catalog No. OEC 5516. The Model AWD packer is an electric line set packer with a set of upper slips 232 and a set of lower slips 234 which are located on either side of a resilient sealing element package 236.

The lower end of the straight slot guide is threadedly attached at union T to a molded seal unit 238 which is in turn threadedly attached at union T to an indicating collet sub 242.

The molded seal unit 238 has resilient seals 240 positioned about the external circumference thereof. The molded seals 240 are retained in position on the seal unit 238 by the upper end of the indicating collet sub 242.

The inner mandrel 244 is threadedly attached to an indicating bottom end 245 which has a raised ring 246 formed on its inner bore which forms detents on either side thereof. When the seal unit 238 is run in the hole on the end of the production string P, a muleshoe guide 248 on its lower end guides the seal unit 238 into the bore of the sump packer. When the collet 250 of the indicating collet sub 242 contacts the raised ring 246 of the indicating bottom end 245, the operator will see an increase in set down weight followed by a sudden decrease as an indication that the production string has landed in the sump packer.

METHOD OF OPERATION

A sump packer 225 of any convenient design is first run into the well on electric line or by any other convenient means and set in place in an appropriate fashion.

The entire assembly described above is assembled at the surface and run into the well until the weight change described above indicates that the assembly has been landed in the sump packer as described above.

After the assembly has been landed in the sump packer 225, the upper packer 20, shown herein as an hydraulically operated packer, but intended to included any packer suitable for packing off a well bore in addition to providing means to hang production tubing therefrom, is set by dropping ball B into the bore thereof and pumping fluid down the well so as to bring the ball into sealing engagement with the ball seat 70 thereby diverting the fluid through flow port 13 into chamber 14 of the hydraulic setting tool 10.

Figure 20:
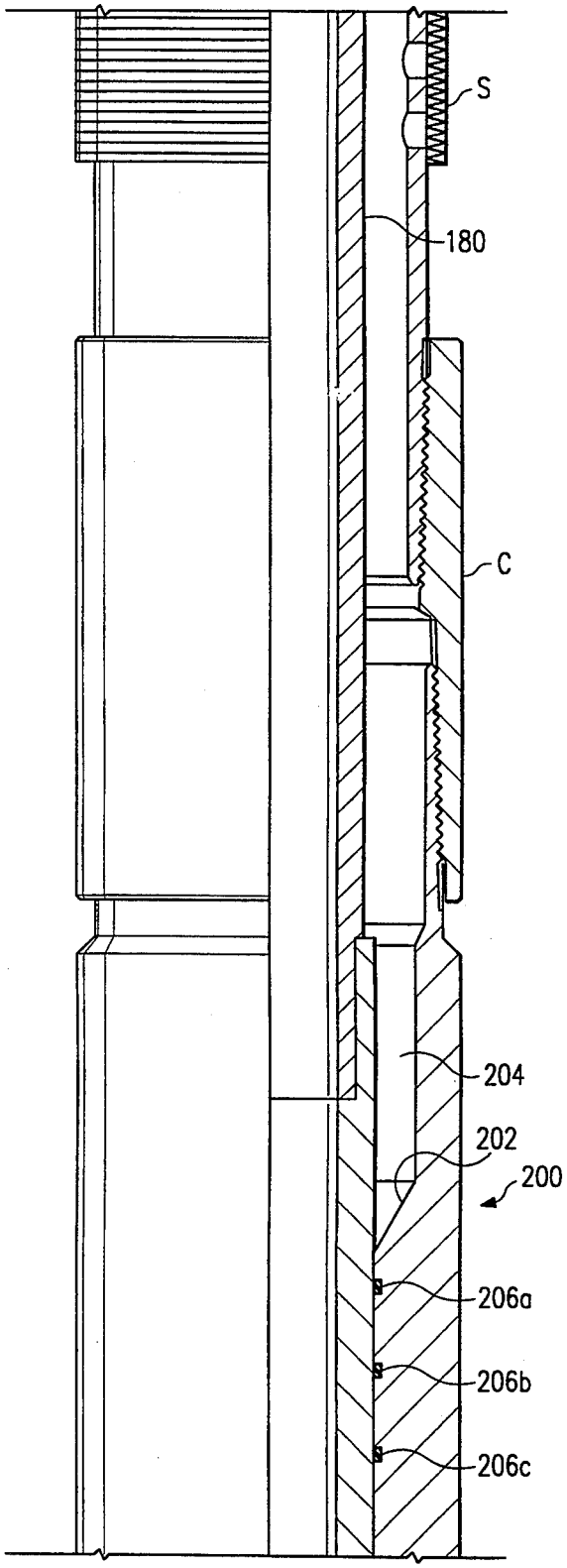

Continued application of pressure forces piston 16 downwardly into engagement with a setting arm 18. The setting force is directed down the outer packer mandrel 26 to the torque transfer lug 27 (FIG. 20). The torque transfer lug 27 redirects the setting force upwardly forcing the slip expanders 32, 32*a* under the slip assembly 30 so that the slips 30 are brought into biting engagement with the casing 5. The torque transfer lug 27 is longitudinally movable through a slot 300 formed in the packer mandrel 26, with its travel being limited by the shoulders 302, 304.

Once the slips 30 are set, the continued application of fluid power to the setting mechanisms of the packer moves the seal expander 29 against the sealing element package 28. The sealing element package 28 is compressed longitudinally between the seal expander 29 and the seal retainer 29*a* thereby causing the sealing element package to expand radially. The radially expanded sealing element package 28 thus seals off the well bore effectively isolating the bore above the packer from the well bore below the packer. After the packer has been set, the pressure of the fluid being introduced into the well bore is increased to shear pin 72 and expel the drop ball B and the expendable ball seat assembly into the blind catcher 76.

Thereafter the well can be gravel packed or other chemical treatment can be applied to the well bore utilizing the gravel pack service tool 50 and the sleeve valve 80 in a manner well known in the art.

Once the well has been successfully gravel packed or otherwise treated, the gravel pack service tool 50, or the appropriate stimulation tool, together with the tail pipe 55 is pulled upward towards the surface thereby bringing the collet shifter 82 into engagement with a profile, not shown, on the inside of the sleeve valve 80. Because the collet shifter 82 is somewhat resilient it is able to flex inwardly to engage and disengage the profile. Continued upward pull closes the sleeve valve and then disengages the shifter from it.

Once the collet shifter 82 is disengaged from the profile, the operator at the surface continues to pull the inner assembly upward until an outer snap ring 128 of the telescoping expansion joint 90 which functions as a first latching means comes into contact with a thickened portion of the production string assembly 58, shown in FIG. 2E.

Continued upward pull on the inner assembly applies longitudinal pressure on a secondary shear screw carrier 130, thereby shearing screw 116. Once the shear screw 116 has sheared, the secondary shear screw carrier 130 is pushed by the outer snap ring 128 longitudinally downwardly until the snap ring drops off the radially inwardly stepped shoulder 126.

However, prior to the snap ring 128 dropping off the shoulder 126 as aforesaid, continued upward pull also enables a second latching means retainer, or snap ring retainer 122, to flex. As the snap ring retainer 122 flexes radially outwardly, a second latching means, lugs 114, moves over the raised intermediate ring 113. This movement over the ring frees the outer tube 94 to telescope longitudinally with reference to the inner tube 92. The outer surface of the inner tube 92 is finished with a serrated, or "phonograph" finish so that the serrated edge 103 of the internal slip 104 enters into biting engagement therewith. This biting engagement prevents the longitudinal retraction of the inner tube 92 into the outer tube 94 once the tubes have been longitudinally extended with reference to each other.

Once the nested tubes of the tubular expansion joint 90 have fully extended, this fact will be communicated to the operator at the surface by an apparent increase in weight on the weight indicator, not shown, which is attached to the hoist on the surface.

Referring now to FIG. 3B, once the operator has determined that the expansion joint 90 has fully extended, he then lowers the assembly until the sawteeth 174 of the ratch latch latching assembly 142 cam into engagement with the helical threads 194 of the ratch latch profile sub 190. However, prior to the threads becoming engaged in the profile, the sawteeth 174 first slide downward and ride up radially outwardly sloped shoulder 178 and engage radially stepped shoulder 179. The engagement of the sawteeth 174 with the radially stepped shoulder 179 both prevents any further independent movement of the sawteeth 174 relative to the latching assembly 142 and props the sawteeth 174 radially outwardly to enable engagement of the sawteeth 174 with the mating teeth in the profile 194.

This downward movement of the assembly also places the seals of the resilient seal assembly 182, 182*a* into sealing engagement with the smooth polished bore portion 196 of the ratch latch profile sub 190. Likewise, the resilient seals 212, 212*a* are placed into sealing engagement with a polished bore 239 of the molded seal unit 238.

With the upper seals 182, 182*a* in sealing engagement with the ratch latch profile sub 190, the lower seals 212, 212*a* in sealing engagement with the polished bore 239 of the molded seal unit in the sump packer 225, and the central portion of the wash pipe 180, which forms a portion of the production tubing string P, in sealing engagement with the o-ring seals 206*a*, 206*b* and 206*c* of the seal bore sub 200, the flow bore of the production tubing P is effectively sealingly isolated from the well bore.

Further downward pressure shears shear screw 144 thereby allowing the nose piece 150 to slide longitudinally relative to the running tool 140 thereby removing the prop from beneath the snap ring 156. With the snap ring released, the running tool is free to be pulled from the hole while leaving the wash pipe 180 firmly latched to the production tubing P.

Referring now to FIG. 3A, the running tool 140 is then detached from the ratch latch latching assembly 142 by an upward pull on the assembly which shears screw 146. Thereafter, the hydraulic setting tool 10, the gravel pack service tool 50, together with the ball catcher sub 56 contained within the bore thereof, the telescoping expansion joint 90, and the tail pipe 55 are pulled from the well bore as a unit.

The production string including the sump packer 225, well screens S, production tubing, P, ratch latch profile sub 190, seal bore sub 200, sleeve valve 80, and the hydraulic upper well bore packer 20, together with the latched - in and sealed wash pipe 180 are left in the well and form a part of the production string P.

When it is desired to place the isolated production zone on production, a perforating device, such as a jet perforator, or any such device which is well known in the art is lowered into the well bore until it is located in the wash pipe 180. Once the perforator is in place, the pipe is perforated thereby establishing flow communication between the production zone and the surface, and the well is placed on production. Alternatively, the wash pipe 80 could have sleeve valves, not shown, threadedly inserted at points along its length as aforesaid. The location of the sleeve valves in the wash pipe would necessarily be selected to position the i sleeve valves adjacent producing formations when the wash pipe is seated and sealed in place as described herein.

ALTERNATIVE EMBODIMENT

Figure 4A:
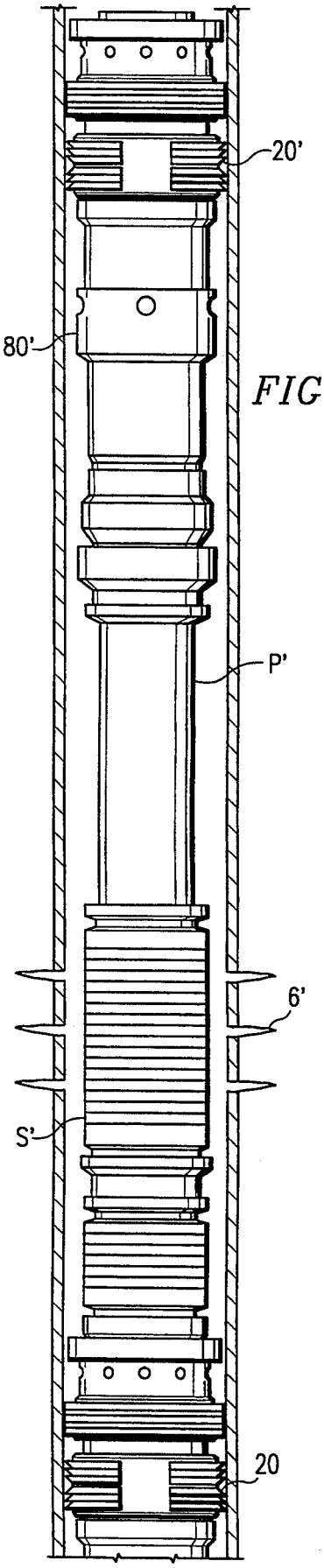
FIGS. 4A and 4B are views, partially in section and partially in elevation of an alternative embodiment of the invention for multi - zonal isolation completions.
Figure 4B:
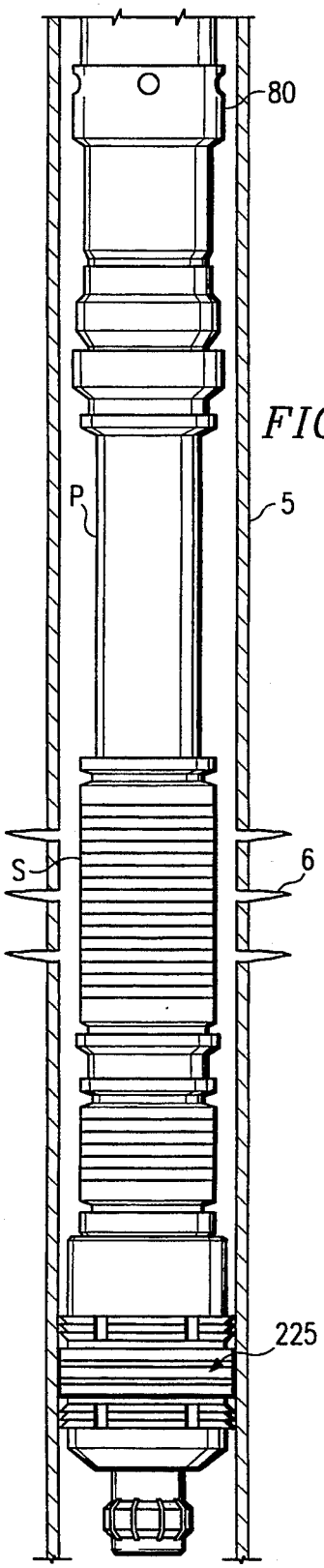

Referring now to FIGS. 4A and 4B, in an alternative embodiment, a sump packer 225 is placed and set in the well casing 5 below the lowest production zone of interest, the well casing 5 having been previously perforated at 6, 6' adjacent the various production zones of interest. A first hydraulic packer 20 having a Ratch - Latch® profile and a polished seal bore positioned within the packer's longitudinal bore is run in the well, together with a first length of production tubing P, a first set of well screens S and a first sleeve valve 80 as aforesaid. The first packer 20 is set so as to place the first well screens S adjacent the lowest producing zone of interest 6. The lowest production zone then the gravel packed in any one of a number of manners well known in the art.

Once the gravel pack is completed, a wash pipe, not shown is sealed in the bore of the sump packer 225 as described above.

Thereafter a second set of screens S', a second length of production tubing P' a second sleeve valve 80' and a second hydraulic packer 20' are run in the hole so that the lower end of the second set of well screens S' is landed and sealed in the bore of the first hydraulic packer 20. It will be understood by one skilled in the art that there may be a length of blank pipe of variable length threadedly inserted between the lower end of the second well screen S' and the first hydraulic packer 20 so that the second screen S' is positioned adjacent the production zone of interest in the general vicinity of the second perforations 6'.

Again the well is gravel packed and a second wash pipe is landed and sealed as aforesaid so as to isolate the second producing zone from communication with the surface.

It will be understood by one skilled in the art that any number of sets of screens, production tubing and packers can be stacked in the manner described in the alternative embodiments section of this disclosure. It is intended and understood that the claims are intended to cover this alternative embodiment as well as a single zone completion.

The operator can then bring each production zone on line by perforating the wash pipe adjacent the zone of interest in the manner described above.

What is claimed is:

1. A method of isolating a production zone and subsequently placing the isolated zone on production comprising the steps of:

running and setting first and second wellpackers each having a smooth seal bore therein above and below the production zone;

running a production string including at least one well production screen and having seal bore subs attached to each end thereof and having a sufficient number of sections of threadedly interconnected blank pipe to space the first packer and the second packer above and below the production zone threadedly connected to one end of the well screen, the uppermost of said sections of blank pipe having releasable latching means attached thereof;

placing a gravel pack assembly including a crossover service tool and a sleeve valve shifting tool within the flow bore of the second well bore packer, and well bore packer having a wash pipe releasably engaged with the gravel pack assembly by shearable means and depending thereform, the wash pipe having sealing means and releasable latching means mounted thereon;

simultaneously running the gravel pack assembly, the well bore packer and the wash pipe into the hole;

gravel packing the well bore;

manipulating the gravel pack assembly to seal the washpipe into said first packer and to latch the wash pipe into sealing engagement therewith;

removing the gravel pack assembly from within the bore of the production string leaving the wash pipe in sealing engagement with said first packer and the second packer; and, establishing communication between the flow bore of the wash pipe and the producing zone.

2. The method as defined in claim 1, including the step of establishing communication between the flow bore of the wash pipe and the producing zone by perforating the wash pipe.

3. The method as defined in claim 1, wherein communication is established between the flow bore of the wash pipe and the producing zone by opening a sleeve valve which has been installed intermediate the sections of blank wash pipe.

4. The method as defined in claim 1, including the step of extending the length of the wash pipe by expanding a travel joint coupled between the wash pipe and the work string and securing the travel joint in the expanded position.

5. The method as defined in claim 1, including the step of positively latching the wash pipe onto the tubing string.

6. The method as defined in claim 1, including the step of running a retrieving tool into latching engagement with the washpipe isolation string and retrieving it to the surface.

7. Apparatus for isolating a production interval in a production well of the type including a tubing string and a packer having a tubular mandrel and flow bore coupled in communication with the tubing string comprising:

a washpipe disposed within the tubing string and adapted for sealing engagement within the flow bore of the packer mandrel; and an expandable travel joint coupled to the wash pipe for movement from a retracted position to an extended position relative to the wash pipe.

8. The apparatus for isolating a production interval in a production well as recited in claim 7, including:

retainer means releasably coupled intermediate the wash pipe and the travel joint for retaining the travel joint in a retracted position relative to the wash pipe.

9. The apparatus for isolating a production interval in a production well as recited in claim 7, further comprising:

ratchet means coupled intermediate the wash pipe and the travel joint for permitting longitudinal extension movement of the travel joint relative to the wash pipe while opposing longitudinal retraction movement thereof.

10. The apparatus for isolating a production interval in a production well as recited in claim 9, the ratchet means comprising a ratchet slip slidably mounted on the travel joint, the ratchet slip having tooth portions oriented to permit only one-way movement of the travel joint relative to the ratchet slip.

11. The apparatus for isolating a production-interval in a production well as recited in claim 7, further comprising:

latch receptacle means connected in the tubing string; and, a latch member coupled to the travel joint, the latch member being mateable in a positively latched union with the latch receptacle means.

12. The apparatus for isolating a production interval in a production well as recited in claim 11, wherein:

the latch receptacle means comprising a tubular latch receptacle coupled to the tubing string, the tubular latch receptacle having an internal latch surface for engaging the latch member; and, the latch member including a collet coupled to the washpipe, the collet having a plurality of radially deflectable arms adapted for insertion into the latch receptacle, each deflectable arm including a radially projecting latching member.

13. The apparatus for isolating a production interval in a production well as recited in claim 12, wherein the internal latch surface is intersected by helical threads and each radially projecting latching member includes a saw tooth coupling member, each saw tooth coupling member being adapted for ratchet engagement with the helical threads on the latch receptacle.

14. The apparatus for isolating a production interval in a production well as recited in claim 12, wherein:

the tubular latch receptacle comprises mateable coarse threads having camming surfaces thereon so as to be ratchetable in one direction with respect to the radially deflectable arms and pitched in relation to the arms to allow rotational unlatching thereof.

15. The apparatus for isolating a production interval in a production well as recited in claim 7, wherein the travel joint comprises:

a first tubular member having a longitudinal bore;

a second tubular member disposed for slidable movement within the longitudinal bore of the first tubular member.

16. The apparatus for isolating a production interval in a production well as recited in claim 15, including:

means attached to the first tubular member and to the second tubular member for opposing withdrawal of the second tubular member from the bore of the first tubular member; and, means coupled to the first and second tubular members for retaining the second tubular member in an extended position relative to the first tubular member.

17. The apparatus for isolating a production interval in a production well as recited in claim 16, wherein the withdrawal opposing means comprises:

detent means formed in the washpipe;

a lug carrier mounted on the wash pipe;

a locking lug coupled to the lug carrier and propped radially outwardly by the detent means; and, a first retaining means shearably attached to the lug carrier and disposed in radially inwardly propping engagement with the locking lug.

18. Well bore isolation apparatus as defined in claim 7, in which the packer having a polished sealing surface on the flow bore of the packer mandrel, the isolation apparatus further including:

a first seal bore sub connected between the well bore packer and one section of well production screen;

one or more sections of tubular well production screen connected in flow registration with each other and connected to and in flow registration with the first seal bore sub;

a second seal bore sub connected in flow registration with the lowermost of the production screens;

a first releasable latching means incorporated into the bore of one of the seal bore subs; and, a first supplemental sealing means disposed on one end of the washpipe, a second supplemental sealing means disposed on the other end of the washpipe, and a second releasable latching means disposed on one end of the washpipe, the supplemental sealing means sealingly engaging the seal bores and being releasably latched in sealing engagement with the polished sealing surface of the packer by cooperative engagement of the first releasable latching means with the second releasable

19. The apparatus for isolating a production interval in a production well as recited in claim 7, wherein the expandable travel joint includes an inner travel joint tube received for telescoping movement within an outer travel joint tube, and further including:

a tubular lock material having a longitudinal flow bore, a first end portion adapted for connecting with the wash pipe and having a second end portion adapted for attachment to the inner travel joint tube, the lock mandrel having first and second mandrel support surfaces, the second mandrel support surface being radially stepped with respect to the first mandrel support surface, and the first mandrel support surface being intersected by a detent for receiving a locking lug;

a tubular coupling sleeve mounted for slidable movement on the tubular mandrel, the tubular coupling sleeve being adapted for attachment to the outer travel joint tube, the tubular coupling sleeve having a counterbore defining a pocket for receiving a ratchet slip; and, a ratchet slip received within the pocket, the ratchet slip having tool portions oriented to permit only one-way movement of the ratchet slip relative to the lock assembly mandrel.

20. The apparatus for isolating a production interval in a production well as recited in claim 19, further including;

a tubular extension sleeve connected to the tubular coupling sleeve, the tubular extension sleeve having a first tubular body portion adapted for sliding movement along the lock assembly mandrel and having a second tubular body portion radially spaced from the locking assembly mandrel by a longitudinal counterbore, the second tubular portion being intersected by a detent for receiving a locking lug;

a locking lug received within the detent in the first mandrel support surface;

a tubular retainer sleeve connected to the tubular carrier sleeve and mounted on the tubular extension sleeve in overlapping relation with the locking lug in the detent; and, shearable means releasably connecting the lug carrier to the tubular extension sleeve.

21. Well bore isolation apparatus as defined in claim 20, further including:

a positive indicator shear ring mounted on the tubular retainer sleeve;

a retainer collar mounted on the tubular retainer sleeve for limiting longitudinal movement of the positive indicator shear ring relative to the tubular carrier sleeve; and, shearable means connecting the retainer collar to the tubular retainer sleeve.

22. Well bore isolation apparatus as defined in claim 19, including:

a running tool mandrel coupled to the lock mandrel and having an end portion adapted for releasable connection to the wash pipe;

a latching assembly coupled to the running tool mandrel including a prop sleeve and a latch mandrel having a counterbore;

a C-ring disposed within the counterbore of the latch mandrel, the C-ring being supported in a propped position by the prop sleeve; and, including shearable means releasably connecting the tubular latch mandrel and prop sleeve to the running tool mandrel.

23. Well bore isolation apparatus as defined in claim 22, including:

sealing means disposed between the running tool mandrel and the latch mandrel.

* * * * *